United States Patent [19]

Coggiola

[11] 4,086,714

[45] May 2, 1978

[54] STEAM IRON BAFFLING

[75] Inventor: James P. Coggiola, Pomona, Calif.

[73] Assignee: General Electric Company, Bridgeport, Conn.

[21] Appl. No.: 793,922

[22] Filed: May 5, 1977

[51] Int. Cl.[2] ..... D06F 75/06; D06F 75/18

[52] U.S. Cl. ..... 38/77.82; 38/77.83

[58] Field of Search ..... 38/77.5, 77.7, 77.8, 38/77.82, 77.83, 77.9, 77.81

[56] References Cited

U.S. PATENT DOCUMENTS

| | | | |
|---|---|---|---|
| 3,156,054 | 11/1964 | Davidson | 38/77.81 |
| 3,497,975 | 3/1970 | Ledbetter | 38/77.82 |
| 3,733,725 | 5/1973 | Trouilhet | 38/77.5 |
| 3,747,241 | 7/1973 | Davidson | 38/77.83 |
| 3,872,613 | 3/1975 | Davidson et al. | 38/77.83 |
| 3,878,628 | 4/1975 | Gowdy | 38/77.82 |

*Primary Examiner*—Patrick D. Lawson
*Attorney, Agent, or Firm*—John F. Cullen; George R. Powers; Leonard J. Platt

[57] ABSTRACT

A steam iron with a water tank, handle structure, ported soleplate, water valve assembly, thermostat control passing through the tank, and a fill opening in the forward handle portion to pass water through a riser tube to fill the iron is standard structure. To this is applied an improvement in the riser tube which comprises a single substantially cylindrical integral plastic member having an outer flange around its middle to rest on the tank with the tube extending down into the tank. The tube has a forward cut-away portion with the rear portion forming a baffle both being in the tank. The tube top is closed by a wall and a forward extension below the top wall is connected to the fill opening with an apertured baffle in the tube behind the extension. The top of the tube has a series of openings for selective use such as for self-clean or spray features and an operable stem extends through one of the openings connecting to the water valve. The riser tube has suitable vents and skirt extension to properly orient and lock the tube in position. Thus, a single integral plastic riser tube fills the water tank, it forms baffling in both the tank and fill opening for water retention, it has suitable vents to aid in filling and emptying and, it forms a guide for other selected features such as self-clean and spray that may be used in a basic iron.

6 Claims, 6 Drawing Figures

Fig. 5.
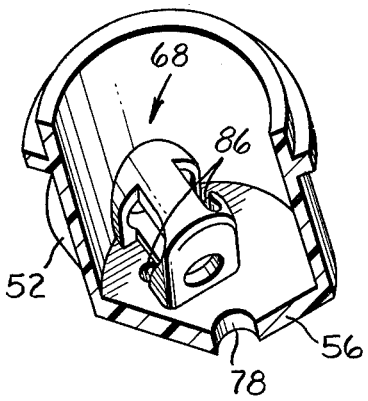
Fig. 6.
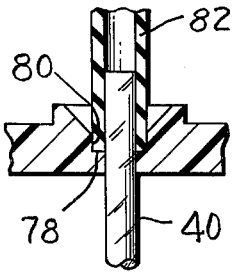
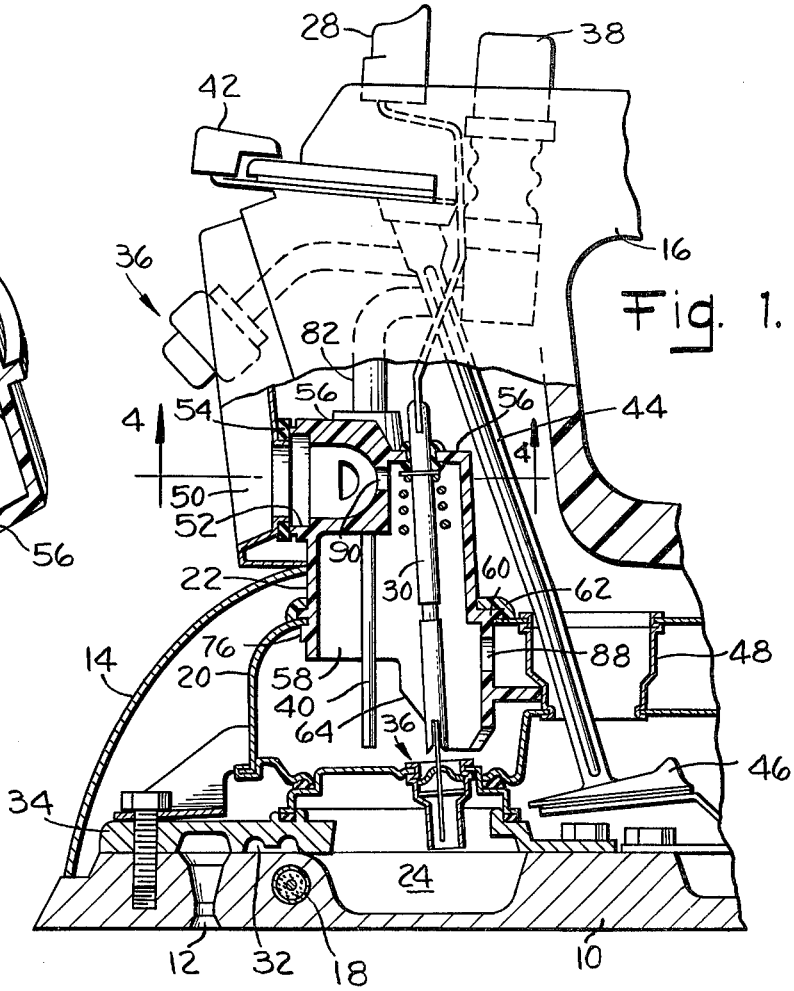
Fig. 1.
Fig. 2.
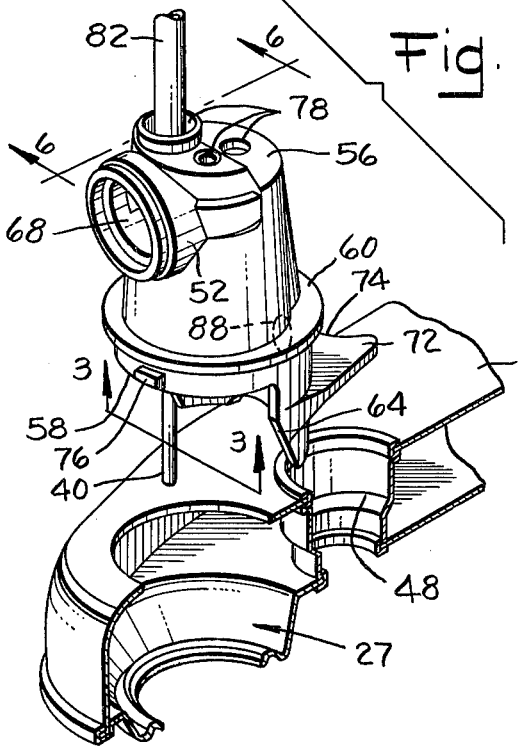
Fig. 3.
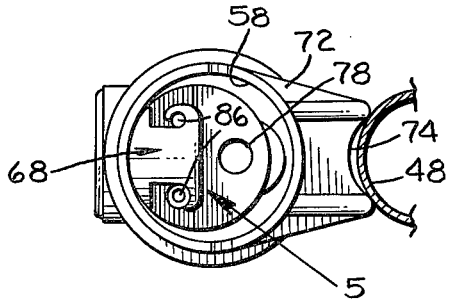
Fig. 4.
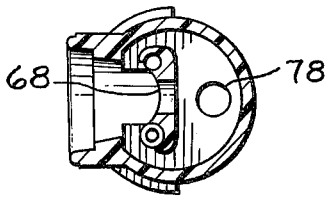

STEAM IRON BAFFLING

BACKGROUND OF THE INVENTION

The invention herein pertains to a steam iron and, more particularly, to an integral plastic riser tube that has flexible uses in many irons and which replaces numerous separate components in a conventional iron.

In irons that use water for either steam or spray or both, it is customary to provide a water tank in the iron shell above the soleplate and under the handle portion and to use conventional controls whereby water is dripped into a boiler and evaporated and directed out steam ports in the soleplate to steam the article. Additionally, manual or power spray attachments may pump a fine spray, onto the garment. In ironing, when the iron is stopped at its forward stroke and depending on the placement of the fill opening, the water tends to keep moving and may be suddenly expelled out the fill opening. Also, when the iron is resting on its heel trapped water may slosh out the fill opening. Further, when the water in the tank boils its viscosity is greatly reduced and the water may be suddenly expelled out the fill opening and this is known as "upchucking". It is common to put baffling in steam iron water tanks to dampen or reduce surges due to momentum of the water and to prevent it being suddenly expelled or "upchucked" during various ironing operations. Typical arrangements are shown in U.S. Pat. Nos. 3,497,975 and 3,878,628 of common assignment and directed to specific structures in irons to prevent sudden expelling of hot water out of the fill opening. Additionally, irons have incorporated other features to a basic iron such as self-clean structure as in U.S. Pat. No. 3,747,241 and self-clean with surge in U.S. Pat. No. 3,872,613 both of common assignment. The iron tanks commonly have walled openings therethrough for the linkage structure of the various features.

SUMMARY OF THE INVENTION

Briefly described, the present invention is directed to a steam iron with an enclosed water tank in a shell under connected handle structure and a ported soleplate for steam passage, a water valve assembly opening and a walled thermostat control means opening through the tank with a water fill opening in the forward handle portion. A riser tube connects the fill and valve assembly openings and this is in the form of a right angle member for filling the iron on its heel position. In this conventional structure the invention improves on the riser tube component by using a substantially cylindrical integral plastic single member with an outer flange around its mid section to rest on the tank with part of the tube extending into the tank around the flange. A forward cut-out tube portion is provided in the tank with the rear tube portion forming a baffle to minimize sloshing in the tank. A top wall closes the upper end of the tube and a forward extension below the top wall is connected and sealed to the fill opening. Directly behind the opening there is provided an apertured baffle means so that fill water is dumped through the apertured baffle and into the tank. The top wall has a series of openings for selective use of different features and an operable stem means extends through one of the openings and is connected to the water valve. Suitable vents assists filling and extending skirt structure orient the riser tube in position in the iron. Thus, the main object of the invention is to provide a unique single integral riser tube structure that can be used with a wide line of irons and which single component functions as a filler tube, and as a baffle, and is selectively usuable for different iron features thus replacing numerous separate parts with a single riser tube providing all the functions for the iron.

BRIEF DESCRIPTION OF THE DRAWING

FIG. 1 is an elevational view, partially in section and broken away, showing the general parts of an iron illustrating the invention;

FIG. 2 is an exploded perspective showing the riser tube and tank structure;

FIG. 3 is a view of the riser tube from below at line 3—3 of FIG. 2;

FIG. 4 is a sectional view taken on line 4—4 of FIG. 1;

FIG. 5 is a partial perspective of the apertured baffle in the direction of arrow 5 in FIG. 3; and FIG. 6 is a part section on line 6—6 of FIG. 2.

DESCRIPTION OF THE PREFERRED EMBODIMENT

Referring first to FIG. 1 there is shown an electric steam iron that may include a spray attachment if desired. The iron includes soleplate 10 with a plurality of steam ports 12 and a shell 14 secured thereto and suitably connected to handle structure 16 in a conventional manner. The soleplate 10 may be cast aluminum with a sheath heating element 18 cast in position. The heating element generally extends in a loop beginning at the rear of the iron and along one side to the forward or pointed end and then rearwardly along the other side to provide substantially uniform heat distribution.

The iron includes means for generating steam by providing enclosed water tank 20 with a vertical outer riser tube means 22 in the forward end portion and which generally is cylindrical but may be any suitable tubular shape. Heretofore this has generally been a separately attached metallic member with various grommets and bearings to accommodate operative linkages that pass through the riser tube and it is this area that the invention improves upon as described below. For steam, soleplate 10 has a steam generator cavity or boiler 24 into which water is dripped under control of a metering water valve assembly 26 that extends into and out the tank through an opening generally indicated 27 (FIG. 2) and including a control button 28 and connected spring-biased vertical stem 30. Water drips through valve 26 from tank 20 onto the heated soleplate, flashes into steam which is distributed through passage 32 under cover 34 and out ports 12 to the ironing surface. A manual spray assembly 36 may be operated by control button 38 to draw water by pump bellows 39 from the tank through water tube 40 to control the spray. Temperature knob 42 operates to thermostatically control the heat generated in the soleplate through the linkage 44 which turns cam 46 to change the setting of the thermostat in a known manner. Thermostat control linkage 44 extends through a walled opening 48 in watertight seal with tank 20. To supply water to tank 20 for steam and/or spray, a suitable fill opening 50 is provided opening directly into a forward extension 52 in riser tube 22. The forward extension 52 is suitably sealed by gasket 54 so that all water entering the opening 50 is directed into water tank 20. The riser tube thus serves as the usual conduit for fill water to enter the interior tank and, depending on the length of riser tube 22, enables the fill opening to be at any desired height on the front of the iron.

The present iron is a non-pressurized version with the atmosphere communicating directly with the tank interior through riser tube 22 as shown in FIG. 1. Provision is made to prevent water from being suddenly expelled and sloshing out of the fill opening during the normal ironing operation. This generally comprises separate baffling structure in the main portion of the tank and/or directly in the riser tube itself both as shown at 48 and 50 respectively in said U.S. Pat. No. 3,878,628. It will be apparent that a figure eight or a side or uneven ironing motion causes the water in the tank to slosh and it will be expelled out the fill opening during jerking movements and especially when suddenly up-ended on its heel rest position. Since the water is hot, it is necessary to prevent this expelling out the fill opening. Normal internal sloshing of the tank water generally is reduced by conventional separate internal baffling as at 42 in said U.S. Pat. No. 3,497,975 patent which dampens surges of the tank water.

Additionally, other features of the iron that may be added such as the self-clean of U.S. Pat. No. 3,747,241 and self-clean with extra surge as in U.S. Pat. No. 3,872,613 all require extra operating linkage to pass through the riser tube to reach the appropriate handle portion of the iron to operate the desired function.

To this end, and in accordance with the invention herein, a single integral riser tube member 22 is used to perform numerous functions normally requiring additional and separate structure but which single tube may be used as a standard part in a line of irons that may have one or more of the additional features. By reducing the parts and forming a single riser tube of plastic, the cost is considerably reduced and wide flexibility is provided in a main component of an iron line. Thus, as best seen in FIG. 2, riser tube 22 is specifically formed as an integral member capable of many functions. For this purpose, tube 22 is a substantially cylindrical integral plastic member made from a single molding with a top wall 56 that closes the upper end of the tube and with the bottom end 58 of the tube being open. Since tube 22 replaces conventional metallic separate riser tubes that are fabricated onto tank 20, and for standardizing parts so tube 22 may be used for a number of irons with different features, the tube is provided with a flange 60 generally in the midsection and extending completely around the tube. To receive the tube 22, tank 20 is provided with a conventional opening 27 in its forward end and the tube is set in the opening to rest on the tank whereby the tube extends into the tank completely around and below the flange as seen in FIG. 1 to connect the fill 50 and valve assembly opening 27. In other words, tube 22 is mounted on tank 20 by resting the tube on flange 60 and providing a suitable seal such as silicone 62 between the flange and the tank. Since all the tube below flange 60 extends into the tank, it is possible to use the tank to replace a normal baffle in the tank and to this end, the tube is cut on the bias to provide a forward cutout portion 64 in the tank. The remaining rear portion 66 thus forms a baffle in the tank to damp surges and it is difficult for water to rise in the tube 22 unless it enters through the forward portion 64. As seen in FIG. 2, the forward extension 52 connects the upper end of the tube with fill opening 50. For further preventing any upchucking or expelling of hot water out this fill opening 50, an additional apertured baffle means 68 is molded into the tube directly behind the extension 52 as a barrel like baffle as seen in FIG. 5. Because of the shape of apertured baffle 68 the entire riser tube 22 may be formed of a single molding.

In order to orient and fixedly locate riser tube 22 in tank 20, the rear portion 66 is provided with a skirt 72 that has a curved cutout 74 to abut the walls of thermostat opening 48 as shown in FIG. 3, for locking the tube in position in conjunction with a molded projection 76 on the forward tube portion. Thus, to install the riser tube 22, it is tilted to the right in FIG. 2 whereupon the skirt 72 is inserted through opening 62 and back to abut opening 48 as in FIGS. 1 and 3. Then the tube is tilted back and snapped into position whereupon projection 76 bends the wall of the tank sufficiently to pass through opening 27 and a suitable seal such as a liquid silicone sealant adhesive is preferably externally applied. When this silicone is cured it fixedly seals and locks the tube in the tank below the upper wall of the tank.

To provide flexibility to the single riser tube, a series of openings 78 is provided in top wall 56 and these are selectively used or not depending on the desired characteristics or functions of the iron. For example, as shown in FIGS. 1 and 2, two of the openings 78 are used, the larger accommodating water valve stem 30 and one of the smaller openings being countersunk at 80 (FIG. 6) to grasp and hold flexible pump tube 82 which is connected to the smaller fixed water tube 40 as shown in FIG. 6. With the countersink, it is merely necessary to push flexible tube 82 into position where it is firmly held by friction as seen in FIG. 6. For firmly locating fixed water tube 40, the barrel shape apertured baffle 68 may be directly formed with spaced bearing surfaces 86 which are merely elongated plastic surfaces disposed directly below a corresponding opening 78 in the top wall 56. Thus, water tube 40 is slid through opening 78 in the riser tube from the top and is firmly held in position by long bearing surface 86 and is firmly attached to flexible pump tube 82 and held in the riser by the countersink arrangement 80. Thus, the series of openings 78 are selectively usable to provide different iron features in a standardized riser part.

For venting the iron to permit filling, a vent hole 88 in the rear tube portion 66 is provided in the rear portion acting as tank baffling closely adjacent to and just below flange 60 as seen in FIG. 2. Additional vent 90 clears the area through baffle 68.

Thus, the single molded integral plastic riser tube 22 provides a component that may be standardized and used in a wide line of irons depending on what features or functions are desired and any suitable number of openings 78 may be used as will be apparent. The riser tube/baffle 22 is firmly mounted to the water tank by an adhesive and is locked and oriented in position by the structure described. Skirt 72 serves as an assembly aid by orienting the riser tube with respect to the centerline of the water tank. The riser tube conveys water from the fill opening to the water tank and the lower skirt 72 and upper baffle 68 act in unison to replace the usual tank baffling and retain the water during ironing motion. By molding in the bearings 86, upper baffle 68 also functions as a bearing for a rod therethrough as may be used in a self-clean iron of the U.S. Pat. No. 3,747,241 type and, with opening 78, it also forms a sealing fit for water tube 40 thus avoiding the normal additional structure such as grommets. Thus, the one integral riser tube 22 with its particular geometry can be used for a large number of irons of many different models.

While I have hereinbefore shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a steam iron having an enclosed water tank in a shell under connected handle structure and a ported soleplate for steam passage, a water valve assembly opening and a walled thermostat control means opening through said tank, a water fill opening in the forward handle portion, and, a riser tube connecting the fill and valve assembly openings, the improvement in said riser tube comprising, a substantially cylindrical integral plastic member having an outer flange therearound to rest on said tank with the tube extending into said tank around said flange, a forward cutout portion of said tube within said tank, the rear tube portion forming a baffle in said tank, a top wall closing the upper end of said tube, a forward extension below the top wall and connected to said fill opening, apertured baffle means in said tube behind said extension, a series of openings in said top wall for selective use thereof, and operable stem means in one of said openings connected to the water valve, whereby a single integral plastic riser tube functions for filling the iron, acting as a baffle in the tank and in said tube, and is selectively usable through said openings for different iron features.

2. Apparatus as described in claim 1 wherein said rear tube portion has a vent hole within said tank adjacent and below said flange.

3. Apparatus as described in claim 2 wherein said rear tube portion has a skirt extending rearwardly and below said vent in the tank, said skirt having a cut-out to abut said walled thermostat opening to orient and fix said riser tube in position.

4. Apparatus as described in claim 3 wherein said tube has a projection on said forward tube portion whereby when said skirt orients and fixes the tube, the projection snaps into the tank to lock the tube in position.

5. Apparatus as described in claim 4 wherein one of said openings in said top wall is countersunk into said tube for receiving a flexible tube in friction engagement therewith and sealing means between said flange and tank compressed by locking the tube in position.

6. Apparatus as described in claim 5 wherein said apertured baffle means in said tube is formed with spaced bearing means disposed directly below an opening in said top wall.

* * * * *